United States Patent [19]

Plath

[11] Patent Number: 4,612,784

[45] Date of Patent: Sep. 23, 1986

[54] CIRCULAR KNITTING MACHINE AND METHOD OF PRODUCING JACQUARD-PATTERNED PLUSH WEBS

[75] Inventor: Ernst-Dieter Plath, Albstadt, Fed. Rep. of Germany

[73] Assignee: Sipra Patententwicklungs-und Beteiligungs-Gesellschaft, Stuttgart, Fed. Rep. of Germany

[21] Appl. No.: 672,847

[22] Filed: Nov. 16, 1984

Related U.S. Application Data

[63] Continuation of Ser. No. 440,024, Nov. 8, 1982, abandoned.

[30] Foreign Application Priority Data

Nov. 14, 1981 [DE] Fed. Rep. of Germany ..... 3145307

[51] Int. Cl.[4] ..... D04B 9/12

[52] U.S. Cl. ..... 66/9 R; 66/93; 66/107

[58] Field of Search ..... 66/9 R, 92, 93, 107, 66/108 R, 108 A

[56] References Cited

U.S. PATENT DOCUMENTS

| | | | |
|---|---|---|---|
| 2,715,824 | 8/1955 | Krauss et al. | 66/93 |
| 2,966,782 | 1/1961 | Deiss et al. | 66/9 R |
| 3,406,538 | 10/1968 | Beckenstein | 66/9 R |
| 4,156,356 | 5/1979 | Holder | 66/108 R |
| 4,307,586 | 12/1981 | Schmidt | 66/108 R X |

FOREIGN PATENT DOCUMENTS

| | | | |
|---|---|---|---|
| 1128076 | 11/1962 | Fed. Rep. of Germany . | |
| 2038376 | 7/1980 | United Kingdom | 66/107 |
| 2085035 | 4/1982 | United Kingdom | 66/93 |

*Primary Examiner*—Wm. Carter Reynolds
*Attorney, Agent, or Firm*—Michael J. Striker

[57] ABSTRACT

A multi-system circular knitting machine for producing jacquard-patterned one-face plush webs of one main thread and at least one plush thread has a needle cylinder provided with a plurality of needles, a plate ring provided with pairs of controllable loop-sinking plates and knockover plates, and needle and plate controlling cams each system of the machine is subdivided into a series of system portions. The main thread is inserted in a needle and processed exclusively in the first system portion. The controlling cams are formed such that only the knockover plates are withdrawn from the first system portion, while in the last system portion, both the knockover plates and the loop sinking plates are withdrawn from the working zone.

3 Claims, 12 Drawing Figures

SYSTEM S
S1
S2
S3
NEEDLE SELECTION POINT
NEEDLE SELECTION POINT
A
B
C
D
E
F
III
IV
V
VI
VII
VIII
IX
X
III
10
11
12
21
23
26
27
28
28a
28b
29
30
31

CIRCULAR KNITTING MACHINE AND METHOD OF PRODUCING JACQUARD-PATTERNED PLUSH WEBS

This application is a continuation of application Ser. No. 440,024, filed Nov. 8, 1982, now abandoned.

BACKGROUND OF THE INVENTION

The present invention relates to a multi-system circular knitting machine for manufacturing of jacquard-patterned one-face plush webs of one main thread and at least one plush thread, as well as to a method of producing jacquard-patterned plush webs.

Circular knitting machines and knitting methods of the above-mentioned general type are known in the art. A known machine has a needle cylinder provided with latch-type needles, a plate ring provided with pairs of controllable loop-sinking plates and knockover plates, and cam members for controlling the needles and the plates. One of such circular knitting machines disclosed, for example, in the German Pat. No. 1,128,076 (corresponding to U.S. Pat. No. 2,966,782) has the above described tool and is used for producing coarse thread lining webs. It is known to produce jacquard-patterned plush webs of several differently colored plush threads. It is, however, conventional to process in each mesh row only one plush thread and to distribute several plush threads over several neighboring mesh rows whose plush loop is then completed to a colored plush picture. At locations of the web at which in correspondence with the pattern no plush loops must be available, the plush threads in the individual mesh rows are together with the main threads knitted to a mesh of the main knitting. It must be taken in the account that the patterned plush outer face is provided with plush loops in a relatively thin manner, despite the fact that many plush threads are processed in the main knitting. It is seldom meaningful to process more than two different plush threads, since in the event of four different plush threads per unit area the knitting can obtain only 25% of the plush loop of one-color unpatterned plush knitted fabric.

SUMMARY OF THE INVENTION

Accordingly, it is an object of the present invention to provide a circular knitting machine for and a method of producing jacquard-patterned plush web, which avoids the disadvantages of the prior art.

More particularly, it is an object of the present invention to provide a circular knitting machine for and a method of producing Jacquard-patterned plush webs, in accordance with which plush webs can be produced for further processing to the velour webs, wherein in one and the same mesh row of the knitting plush loops of different plush threads and correspondingly a denser plush pile are obtained.

In keeping with these objects and with others which will become apparent hereinafter, one feature of the present invention resides briefly stated, in a multi-system circular knitting machine for producing jacquard-patterned one-face plush webs of one main thread and at least one plush thread, which has a needle cylinder provided with a plurality of needles, and a plate ring provided with pairs of controllable loop-sinking plates and knockover plates, and controlling means including cams for controlling the needles and the plates, wherein each system of the machine is subdivided into $n+1$ system portions with $n>1$ is the number of pattern factors, for example different plush threads, and the needle cam is formed so that the needles are drawn in a last portion of each system to a mesh knockover position and in other portions of the same system only to a loop-sinking position, and a plate cam is formed so that in a first main thread processing portion of each system a relative displacement of the knockover plate to the loop-sinking plate takes place.

Another feature of the present invention is a method which includes the following steps:

(a) in the first system portion of each system driving out the needles for introducing the main thread and simultaneously drawing back the associated knockover plate from a thread introducing region, and subsequently drawing back the needles to shortly before a knockover position with loop-sinking of the main thread over the associated loop-sinking plate, (b) in a second portion of each system displacing the knockover plate to a position arresting the sunk main thread with simultaneous driving out the selected needle for introducing a first plush thread and subsequently drawing back the needle shortly before the knockover position with loop-sinking the first plush thread over the knockover plate, (c) in at least further portion of each system driving out the selected needle for receiving at least one further plush thread and subsequently drawing back the needle with loop-sinking the second plush thread under the associated knockover plate, and in the last portion subsequently further drawing back all needles to the knockover position after drawing back the associated loop-sinking plates and the knockover plates, and subsequently driving out the loop-sinking and knockover plates for post-tensioning of a formed plush loop.

In the circular knitting machine formed in accordance with the present invention, both the raised/depressed pattern as well as the above-mentioned multicolored pattern can be produced, wherein in each mesh row both differently colored plush loops and loop-free locations can be formed. For forming loop-free locations, the plate cam of the circular knitting machine can advantageously be formed so that, in accordance with a further feature of the present invention, in addition to the first system portion of each system the knockover plate in at least one further system portion is movable back to the loop-sinking plate from the thread introducing region and thereby a loop formation is prevented.

The produced knitted web has in its individual mesh rows different loops in correspondence with a desired jacquard pattern. When several plush loops of one color lie near one another, a long loop overlaps the other plush colors. In the main knitting of the web the different plush threads are knitted-in only individually, being distributed in accordance with the pattern. After shearing of the plush web to a velour web, the pile thread formed of different plush threads are identically long. While it is true that during shearing of long plush loops a greater thread loss takes place than in the short plush loops, this shearing loss is considerably smaller than when the plush thread forming the long loops are bound in the main thread machines.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
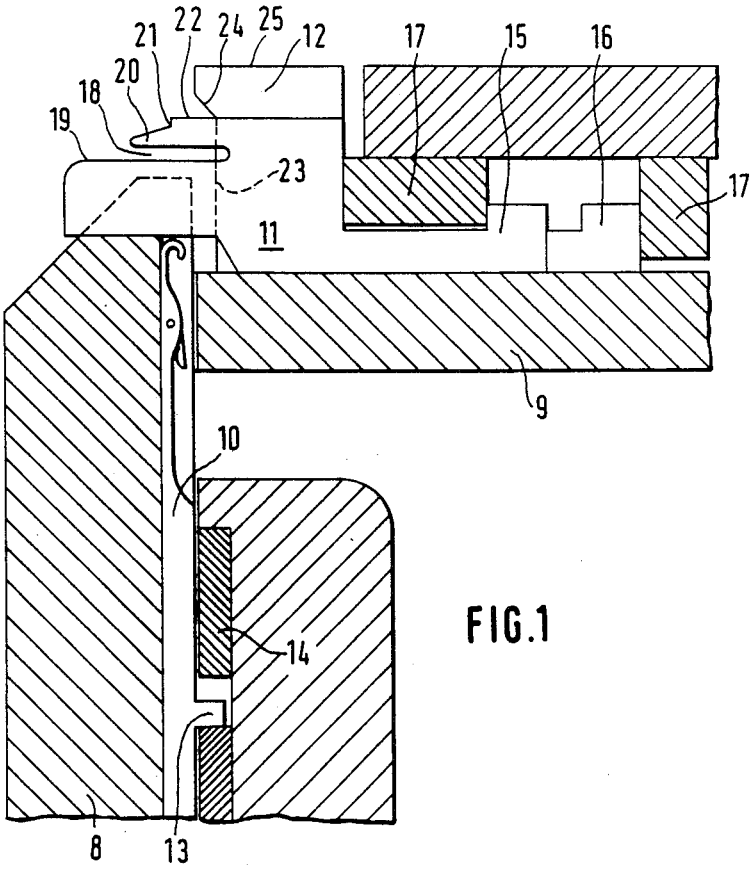
FIG. 1 is a sectional view schematically showing a knitting tool and its controlling means, of a knitting machine and a method in accordance with the invention.

FIG. 1 shows a knitting tool for multi-system circular knitting machine whose entire construction is not shown. The circular knitting machine has a needle cylinder 8 provided with latch-type needles 10,and a plate disc 9 in which loop-sinking plates 11 and knockover plates 12 are arranged. Each needle 10 is associated with a respective loop-sinking plate 11 and a knockover plate 12. The latter are supported together in a longitudinally displaceable manner in a slot of the plate disc 9. Each of the above-mentioned tools has at least one control foot for controlling its longitudinal movement, and more particularly the needle 10 have a needle foot 13 which is controlled by cylinder cams 14. The loop-sinking plates 11 and the knockover plates 12 have a control foot 15 and 16 which are controlled by plate cams 17.

The loop-sinking plate 11 has a known plate shape with upper edge 19 transitting in a longitudinal slot 18, a projection 20 located thereabove and having a plush thread-retaining groove 21, and an upper edge 22. The knockover plate 12 has a vertical end edge 23 limiting the length of the slot 18 of the loop-sinking plate 11, an inclined pressing edge 24 which overlaps the upper edge 22 of the loop-sinking plate 11, and an upper edge 25.

Figure 2:
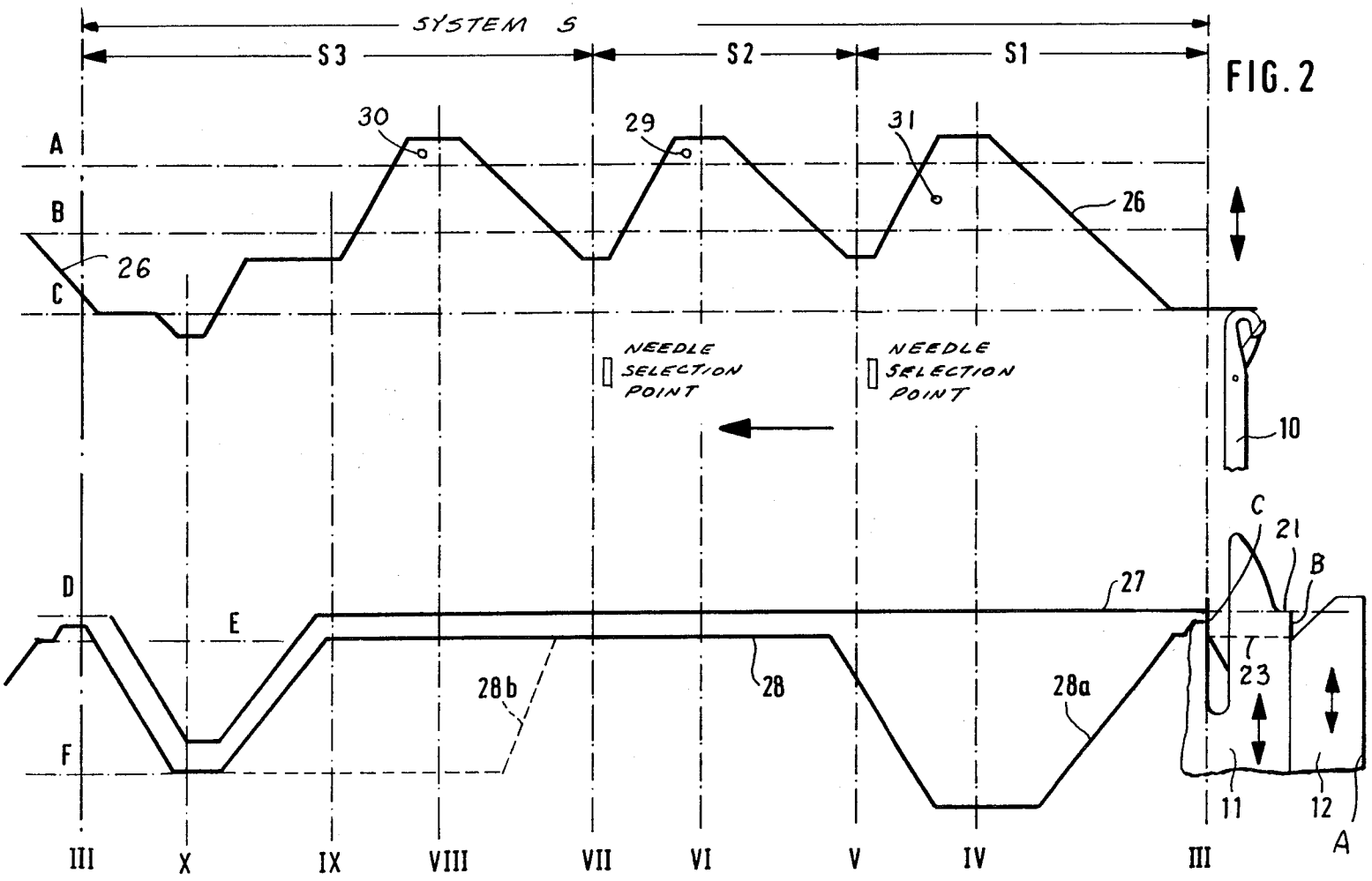
FIG. 2 is a view schematically showing control curves of individual knitting tools over portions of a system of the circular knitting machine in accordance with the invention.

All systems of the multi-system circular knitting machine are subdivided into system portions whose number corresponds to the number of the differently colored plush threads to be processed. When n different plush threads must appear in one mesh row, the system is subdivided into $n+1$ system portions, whereby it is assumed that $N>1$. In the known embodiment two differently colored plush threads must be processed so that the system is subdivided into three system portions. FIG. 2 shows a cylinder cam curve 26 for the needles 10, a plate cam curve 27 for the loop-sinking plates 11, and a plate cam curve 28 for the knockover plates 12 in the region of three system portions S1, S2 and S3 of a system (S) of the circular knitting machine. Dash-dot horizontal lines to the cylinder cam curve 26 are a thread introducing level A, a loop-sinking level B and a mesh knockover level C of the needles 10, as well as a loop-sinking level D of the loop sinking plates 11, a loop-sinking level E of the knockover plates 12 and an immovable position level F of both plates 11 and 12. Vertical dash-dot lines III, IV, V, VI, VII, VIII, IX and X identify locations of the system in which FIGS. 3-10 show the relative position of the tools 10–12 of the circular knitting machine. In the location between lines IX–X, all needles 10 knit; between lines VII–IX, needles selected for plush thread 30 of the second color only are rising while all remaining needles stay below; between lines V–VIII, needles selected for the plush thread 29 of the first color only are rising while all remaining needles stay below; and betweem lines III–V, all needles are rising.

In the system portion S1 a main thread 31 is processed by all needles 10, in the system portion S2 a plush thread 29 of a first color is processed by selected needles 10, and in the system portion S3 a plush thread 30 of a second color is processed by other selected needles 10. As can be recognized from the cylinder cam curve 26, the needles 10 in the system portions S1–S3 are drawn after the thread receipt from the thread introducing level A only to a short distance under the loop-sinking level B. The needle passage direction through the system portions is identified by a thick arrow in the center of FIG. 2. The simultaneous movement of both plates 11 and 12 is illustrated by the plate cam curves 27 and 29 and is shown in the detail in FIGS. 3–10.

Figure 3:
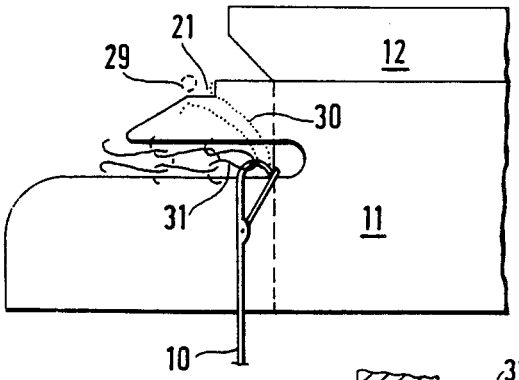
FIGS. 3–10 are views showing a relative position of the knitting tool in connection with the processed threads at locations identified in FIG. 2 by reference numerals III, IV, V, VI, VII, VIII, IX and X of each system.

FIG. 3 shows the initial position of the tool 10, 11 and 12 at the location III of the cam curves 26–28. The needles 10 are located at the level C and hold respectively a mesh of the main threads 31 and one of both plush threads 29 or 30. The loops of both plush threads 29 and 30 of which one plush thread 29 is shown in dash-line and the other plush thread 30 is shown in dot-line, lie in the plush thread receiving groove 21 of the loop-sinking plate 11 and undergo there a post-tensioning by the loop-sinking plate. (In one needlehead, the main thread 31 and the plush thread 29, or the main thread 31 and the plush thread 30 can be retained). The loop-sinking plate 11 and knockover plate 12 are located at their loop-sinking levels D or E.

Figure 4:
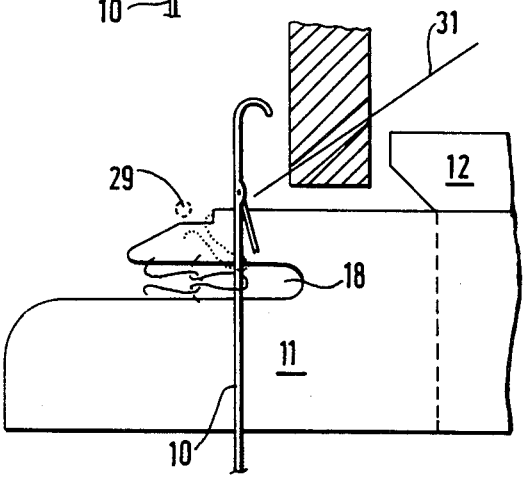
Figure 5:
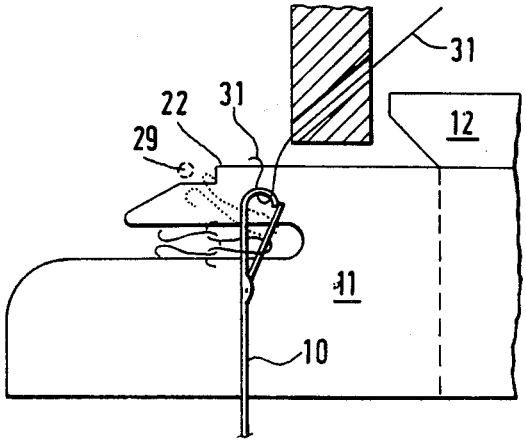
Figure 6:
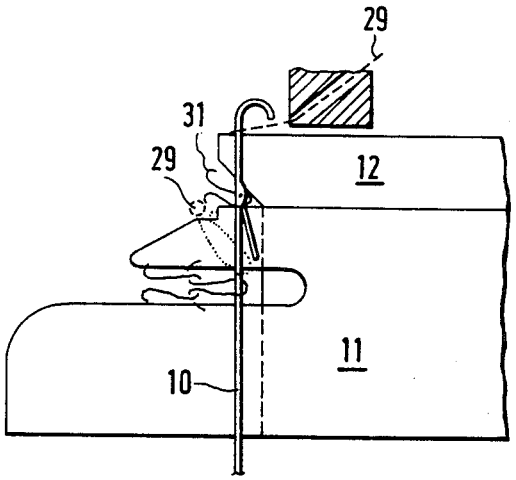
Figure 7:
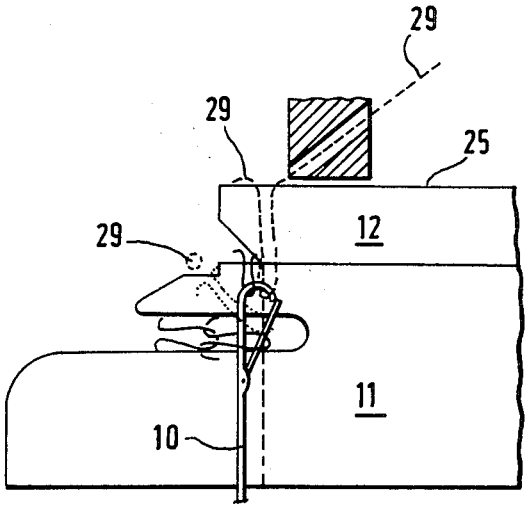

From the initial position shown in FIG. 3, all needles 10 in the first system portion S1 are driven in accordance with FIG. 4 above the thread introducing level A for receiving the main thread 31 shown in solid line A. Simultaneously the knockover plates 12 move back in correspondence with a portion **28*a* of the plate lock curve 28 to the immovable position level F, whereas the loop-sinking plates 11-remain at their loop-sinking level D. The meshes formed before by the needles 10 are arrested in the slot 18 of the loop-sinking plates 11 and slide in accordance with FIG. 4 from the needle head over the needle latch to the needle shaft. Then the needles 10 are drawn to the position under the loop-sinking level D shown in FIG. 5, whereas they sink the main threads 31 over the upper edge 22 of the loop-sinking plates 11 to form loops. The knockover plates 12 are moved out in correspondence with the course of the plate cam curve portion 28*a*** to their sinking level E.

A first needle selection takes place before the system portion S2. The selected needles 10 are moved out in accordance with FIG. 6 again to the thread receiving level A and engage the first plush thread 29 shown in dash lines. After this the needles 10 are again drawn over the sinking level B to the position shown in FIG. 7, whereby they sink the loops of the first plush thread 29 over the upper edge 25 of the knockover plate 12. At the locations at which no needles are moved out, the first plush thread 29 lies extending longitudinally on the upper edge 25 of the knockover plate 12, without forming loops.

Figure 8:
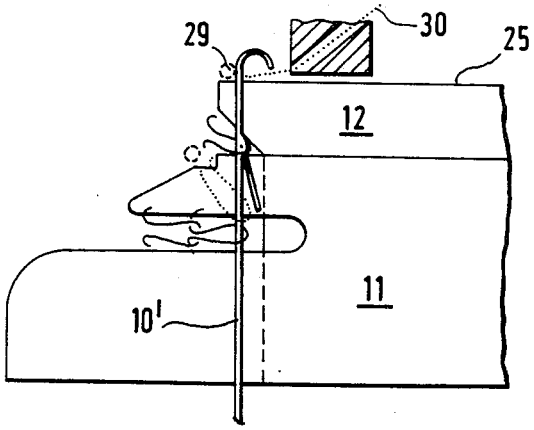
Figure 9:
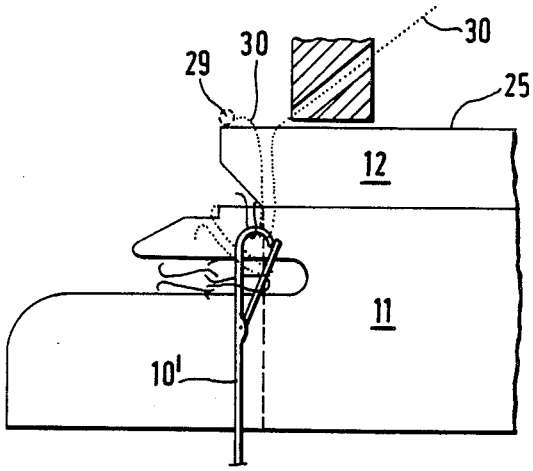

A second needle selection takes place before the system portion S3. The needles 10' selected here are moved out in correspondence with FIG. 8 analogously to FIG. 6 to the thread receiving level A and engage the second plush thread 30 shown in dot line. The thread guidance is performed in such a manner that the first plush thread 29 extends longitudinally behind the needle head of the needle 10' on the upper edge 25 of the knockover plate 12 as shown in FIG. 8. Subsequently, the needles 10' are drawn again to above the sinking level B to the position shown in FIG. 9, whereas they sink the second plush thread 30 above the upper edge 25 of the knockover plate 12 to plush loops.

Figure 10:
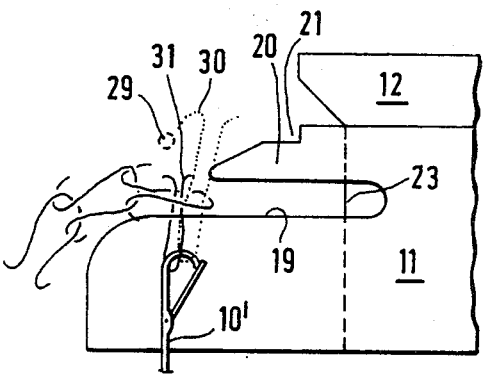

If more than two different plush threads are introduced, a further system portion S4 will follow, in which the third plush thread will engage. In the known embodiment with only two different plush threads 29 and 30, the sinking plates 11 and the knockover plates 12 at the end of the system portion S3 are simultaneously moved back to their immovable position F, and all needles 10 and 10' are drawn to under the mesh knockover level C, so that the loops of the plush threads 29 and 30 and the main thread 31 pre-sunk in accordance with FIG. 10 are knocked above the lower upper edge 19 of the sinking plate 11. After the knocking step both plates 11 and 12 move again forwardly, whereas the projection 20 engages and post-tensions with the receiving groove 21 the plush loop formed of the plush thread 29 or 30 (FIG. 3), in dependence upon which needle is selected for the plush thread 29 or 30. The knocked over meshes are displaced during upward movement of the needles 10 to the knockover level C by the straight end edge 23 of the knockover plate 12 over the head of the needle, so that the needle during movement upwardly cannot cut into the old mesh. The newly formed mesh located in the needle head is arrested during upward movement of the needle 10 toward the knockover level C by the slot 18 of the sinking plate 11, as shown in FIG. 4.

Figure 11:
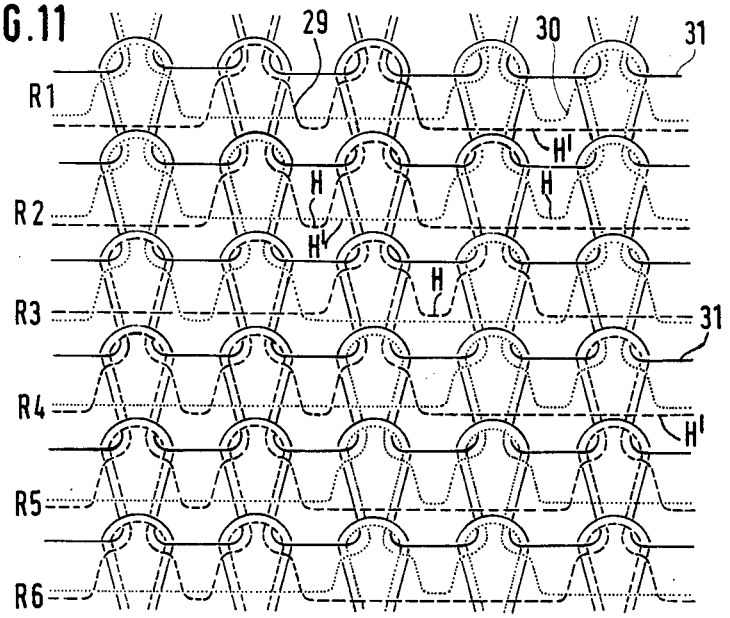
FIG. 11 is a knit pattern of a web formed with two different plush threads.

As can be seen from FIG. 11, in each mesh row R1, R2, R3 . . . R6 the loop of the first plush thread 29 shown in dash line and the loop of the second plush thread 30 shown in dot line are located. Individual loops are identified with reference letter H. At the location when the loops of one plush thread are arranged near one another, they are overlapped by a longer loop of the other plush thread. Such a longer loop is identified with reference letter H'.

Figure 12:
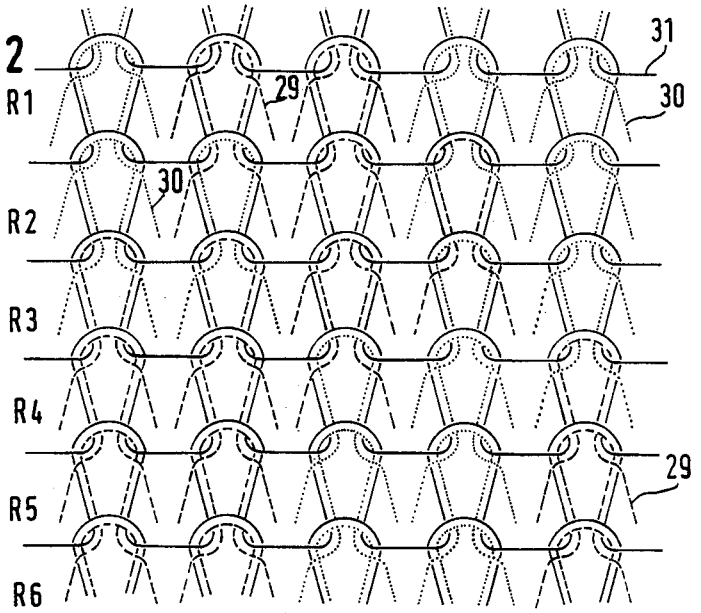
FIG. 12 is a view showing the web after shearing of the plush loops.

FIG. 12 shows that after shearing of the plush web, a velour web with pile threads of equal length of both used plush threads 29 and 30 is produced.

The plush article formed there can also be provided with a raised or depressed pattern. For this purpose, in the system portion S3 of FIG. 2 or in the last thread introducing system portion, the knockover plates 12 can be drawn back in correspondence with the curve portion 28*b* shown in dash line, prematurely so that in the system portion S3 no plush loop is formed from the plush thread 20 supplied there but the plush threads 20 supplied there is processed with a main thread 31 together to a mesh of the main knitting. The curve portion 28*b* can be, however, arranged also after processing of several colors, so that a multi-color pattern with the raised or depressed pattern is produced.

It will be understood that each of the elements described above, or two or more together, may also find a useful application in other types of constructions differing from the types described above.

While the invention has been illustrated and described as embodied in a multi-system circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the stand-point of prior art, fairly constitute essential characteristics of the generic or specific aspects of this invention.

What is claimed as new and desired to be protected by Letters Patent is set forth in the appended claims.

1. A multi-system circular knitting machine having a needle cylinder provided with a plurality of needles, a plate ring provided with plates arranged for movement into and out of a working zone of the needles, and control cams cooperating with the plates for producing jacquard-patterned one-face plush webs of a main thread and at least two plush threads whereby each plush thread is inserted in a selected needle in separate system portions of a series of system portions in each system and subsequently knitted together with the main thread into the mesh, the machine comprising, separately controllable plates arranged in pairs with the number of pairs corresponding to the number of needles which are present in the needle cylinder, one plate in each pair being a loop sinking plate for processing the main thread, and the other plate being a knockover plate for processing the plush threads;

the series of system portions of each system of the machine including a first and a last system portion;

means for inserting the main thread in a needle and processing the main thread exclusively in the first system portion;

the shape of the control cams being such that in the first system portion the knockover plates only are withdrawn from the working zone of the needles while in the last system portion both the knockover plates and the loop-sinking plates are withdrawn from the working zone.

2. A multi-system circular knitting machine as defined in claim 1, wherein the shape of the control cams is such that the knockover plates in at least one system portion between the first and the last system portions are shifted back relative to the loop sinking plates starting from a thread introducing position insertion region.

3. A method of producing jacquard-patterned one-face plush webs of a main thread and at least two plush threads in a multi-system circular knitting machine of the type having a needle cylinder provided with a plurality of needles, a plate ring provided with knockover plates and loop-sinking plates arranged for forward and backward movement into and out of a working zone of the needles, and control cams cooperating with the plates whereby each system in the machine is subdivided in a series of system portions having a first system portion and a last system portion, comprising the steps of driving the needles in said first system portion of each system for inserting therein exclusively the main thread, and simultaneously driving back the corresponding knockover plates from a thread introducing position, and subsequently driving down the needles to a position close to a knockover position and simultaneously sinking the loops of the main thread over the corresponding loop-sinking plate;

displacing in a second system-portion of a system the knockover plates into a position in which the loop-sinking of the main thread is stopped while simultaneously driving up selected needles for inserting a first plush thread, and subsequently moving down the needles to a position close to the knockover position while loop-sinking the first plush thread over an adjacent plate;

in said last system portion of each system driving up selected needles for receiving the second plush thread and subsequently driving down the needles while loop sinking the second plush thread over the corresponding knockover plate, and thereafter in the last system portion of each system driving back the loop-sinking plates and knockover plates, and then driving down the needles into their knockover position, and then driving forward the loop-sinking and knockover plates for post-tensioning of a formed plush loop.

* * * * *